US005750921A

United States Patent [19]

Chan et al.

[11] Patent Number: 5,750,921

[45] Date of Patent: May 12, 1998

[54] WASTE-FREE METHOD OF MAKING MOLDING POWDER

[76] Inventors: May L. Chan, 1209 S. Norma; Alan D. Turner, 919 Upjohn, both of Ridgecrest, Calif. 93555

[21] Appl. No.: 888,890

[22] Filed: Jul. 7, 1997

[51] Int. Cl.[6] ..... C06B 21/00

[52] U.S. Cl. ..... 149/19.92; 144/11

[58] Field of Search ..... 149/19.92, 11

[56] References Cited

U.S. PATENT DOCUMENTS

| | | | |
|---|---|---|---|
| 3,652,350 | 3/1972 | Timmermans | 149/19.92 |
| 4,177,227 | 12/1979 | Harvey et al. | 149/19.92 |
| 4,477,297 | 10/1984 | Chi | 149/19.92 |
| 4,482,405 | 11/1984 | Wright | 149/19.92 |
| 4,923,535 | 5/1990 | Waters et al. | 149/19.92 |
| 4,952,255 | 8/1990 | Stanton | 149/19.92 |
| 5,565,651 | 10/1996 | Kom et al. | 149/19.92 |

*Primary Examiner*—Edward A. Miller

*Attorney, Agent, or Firm*—Melvin J. Sliwka; Steven J. Church

[57] ABSTRACT

A process has been developed to produce high-quality high explosive (HE) molding powder which is safe, efficient, has a low-cost, and is non-polluting. The method involves utilizing a chemically inert, non-aqueous carrier fluid as a processing liquid to facilitate the coating process.

10 Claims, No Drawings

WASTE-FREE METHOD OF MAKING MOLDING POWDER

STATEMENT REGARDING FEDERALLY SPONSORED RESEARCH OR DEVELOPMENT

The invention described herein may be manufactured and used by or for the government of the United States of America for governmental purposes without the payment of any royalties thereon or therefor.

MICROFICHE APPENDIX

Not Applicable.

BACKGROUND OF THE INVENTION

1. Field of the Invention

A process has been developed to produce high-quality high explosive (HE) molding powder. This method is a safe, efficient, low-cost, non-polluting technique for producing explosive molding powder. The method involves utilizing a chemically inert, non-aqueous carrier fluid as a processing liquid to facilitate the coating process.

2. Description of the Prior Art

In the past, a procedure to make a typical batch of molding powder required the polymer to be dissolved in an organic solvent to form a lacquer. The lacquer is mixed with a high explosive solid in a large slurry kettle filled with large amounts of distilled water. (Ref: Alternate Supply Source of Polyisobutylene for Composition C-4 Manufacture, Curtis E. Teague, Report No. HDC-115-93, June 1993.)

Over time many processing improvements were made to facilitate the coating process. Some of these improvements included the addition of small amounts of surfactants (i.e. lecithin or alipal) or processing oils to facilitate the adhesion of the polymer to the surface of the HE. This technique helped insure a more uniform coating and the minimization of batch to batch variations. (Ref: Alternate Supply Source of Polyisobutylene for Composition C-4 Manufacture, Curtis E. Teague, Report No. HDC-115-93, June 1993). The use of surfactants or processing oils does not guarantee high quality coating. Furthermore, the exudation of processing oil may occur during pressing of the explosive pellets. If oil leaks out of the charge it will cause the charge to shrink and pull away from the case. If oil exudes into the molding powder it will degrade the coating.

In preparing molding powder using current methods, the lacquer is prepared by adding a polyolefin (i.e. polyisobutylene), a plasticizer (i.e. dioctyl adipate (DOA)), and a solvent (i.e. n-octane) together. The mixture was heated and agitated until all of the polyolefin dissolved. Process oil was then added to the mixture and it was agitated again to mix the ingredients.

The coating procedure comprised the following ingredients: A HE, lacquer, and water. The HE and water were combined and heated to about 80° C. The lacquer was added to this mixture. After all the lacquer was transferred to the mixture the temperature was further raised to about 99° C. to distill off the solvent. After about 15 minutes the temperature was allowed to cool and the sample was de-watered and then dried. (Ref: Alternate Supply Source of Polyisobutylene for Composition C-4 Manufacture, Curtis E. Teague, Report No. HDC-115-93, June 1993, pgs. 12–14.)

BRIEF SUMMARY OF THE INVENTION

One object of the present invention is to offer a process which produces high-quality HE molding powder.

Another object of the present invention is to develop the process so that the technique provides both an efficient and uniform coating, thus minimizing batch-to-batch variations.

Another object of the invention is to develop a process which produces no HE-contaminated water or other waste material and also does not utilize any toxic solvents or Ozone Depleting Chemicals (ODC's).

A still further object of the invention is to reduce the current cost of manufacturing molding powder and at the same time make the entire process more efficient, safer and environmentally friendly.

A typical coating procedure to form the necessary lacquer of this invention involves dissolving a polymeric binder in a small amount of organic solvent, such as ethyl acetate. The HE powder is suspended in the preheated fluorocarbon (FC) fluid (typically at about 60° C.) in a slurry kettle equipped with a heating jacket and mechanical stirring. The lacquer is added slowly to the FC fluid. At this time the mixture is continuously purged with nitrogen to help drive off the excess organic solvent. This purging continues until no more organic solvent can be detected in the mixture. With stirring at moderate to high shear rates, the organic lacquer phase and the non-polar fluorocarbon fluid phase will form an emulsion where the suspended HE can come in contact with the binder in the organic solvent phase very easily. This previous step eliminates the need for a surfactant. As the stirring and heating continues, a step typically referred to as "polishing", the solvent (i.e. ethyl acetate) is allowed to gradually evaporate (and be cold-trapped for recycling). The binder will then coat the HE particles thinly and uniformly. Evidence of proper coating can be determined using a Scanning Electron Microscope (SEM). After coating and polishing is completed, the molding powder is filtered for harvesting and pressed into explosive pellets.

Fluorocarbon fluids such as perfluoroheptane ($C_7F_{16}$), perfluorooctane ($C_8F_{18}$) or perfluorotributylamine are widely available in the commercial market. They are used in various industries as hydraulic fluids, dispersants, chemical reaction media and cleaning solvents. Their chemical inertness and thermal stability allow the liquid to be heated repeatedly with minimal or no degradation (which is good for continuous processing). Furthermore, these oils are not ODC and can be recycled so there is no waste. Additionally, they do not react with HE or other organic compounds upon heating, therefore exhibiting excellent safety properties. Most importantly, FC fluids are immiscible with the organic solvent lacquer phase, which facilitates the dissolved binder coating the surface of the HE particles.

The cost savings and environmental impact in utilizing this new process for making HE molding powder is quite significant. The new process uses no water. Current methods, for making molding powder, as described above, utilize very large amounts of water. Typically, about 3.5–4.0 lbs. of water are needed to manufacture every lb. of molding powder. When the process is complete the water is considered hazardous. (Ref: Alternate Supply Source of Polyisobutylene for Composition C-4 Manufacture, Curtis E. Teague, Report No. HDC-115-93, June 1993, pg. 12). Therefore, special precautions must be taken when disposing of this water. One of the major drawbacks to making molding powders utilizing current techniques is disposing of this water. It is both extremely expensive to dispose of as well as a hazard to the environment. This new process for making molding powder uses no water and allows for the recovery of both the solvent (i.e. ethyl acetate) and the working fluid (i.e. oil) to be used again in the future.

The following molding powders (Table I) were made with great success using the process outlined in this invention. The powders, when examined under a SEM, showed uniform coating for all of the samples.

TABLE I

| | Wt% of solid/binder | | |
|---|---|---|---|
| Binders | Cl-20 | HMX | RDX |
| Hytemp | 95/5, 97/3 | 95/5 | 95/5, 97/3 |
| EVA | 95/5 | 95/5, 97/3 | 95/5 |
| Viton A | 95/5, 97/3 | 95/5 | 95/5 |
| GAP | 95/5 | 95/5 | 95/5, 97/3 |

Cl-20: hexanitrohexaazaisowurtizane
HMX: cyclotetramethylene tetranitramine
RDX: cyclotrimethylene trinitramine
EVA: ethylene vinyl acetate
Hytemp: Polyacrylic elastomer
Viton A: Vinylidine fluoride and hexafluoropropylene copolymer
GAP: Glycidyl azide polymer Pressed CL-20 pellets with over 98% theoretical maximum density (TMD) were made by using the HE molding powders from this procedure.

In accordance with MPEP 608.01(p), this application incorporates by reference the following allowed patent application which has yet to issue. Patent application Ser. No. 07/253,106 filed Sep. 30, 1988 allowed Dec. 30, 1996, provides a more detailed analysis regarding the synthesis of CL-20.

Tests were conducted to determine the sensitivity of the HE molding powder after it had been coated using this new process. A comparison of the safety test results of the CL-20/Hytemp 95/5 sample (17 cm) vs. neat CL-20 (9 cm) (200 micrometer particle size) are in Table II:

TABLE II

| Impact Test - 2.5 kg 50% Point | ABL* Friction Test | Electrostatic Test @ 0.25 Joules |
|---|---|---|
| 17 cm | 10/10 NF** @ 630 lbs. | 10/10 NF** |
| 10 cm | 10/10 NF** @ 300 lbs. | 10/10 NF** |

*Allegheny Ballistic Laboratory
**No Fire

These results indicate that when the molding powder is coated using this process it is much more stable (17 cm v 9 cm) than previous methods used to coat HE molding powders. From a safety standpoint the new process is much easier to handle because it has an increased desensitization to impact than the neat solid.

BRIEF DESCRIPTION OF THE SEVERAL VIEWS OF THE DRAWING

Not Applicable.

DETAILED DESCRIPTION OF THE INVENTION

This waste-free method of making molding powder can be produced in various types of batch sizes. The only limitation on the size of the batch is finding the appropriate types of equipment, glassware, stirrers, etc. The ratio of the ingredients remains constant.

The first step in the process is to obtain some sort of heating element which can be used as a type of "jacket" to heat the solution. This can be accomplished by mechanical means or by using some type of medium which is heated and then transfers the heat to the solution which it is surrounding (i.e. water, oil, etc.).

The first step in the process is to pour a desired amount of fluorinated oil (i.e. $C_7F_{16}$, $C_8F_{18}$ or perfluorotributylamine) into the molding powder mixer vessel. The inert oil must be compatible with temperatures up to about 100° C.

Once a desired amount of oil is added to the vessel it is continuously stirred and heated. The solution is heated between 50°–70° C. The ideal temperature of this solution is 60° C. The polymeric binder is then dissolved in an organic solvent (about a 30–50:1 ratio) such as ethyl acetate, octane, chloroform or methylene chloride to form the necessary lacquer. Next, a desired amount of the HE (CL-20, HMX, RDX, etc.)is added to the heated fluorinated oil liquid while continuously stirring at a low speed. After about 1–2 minutes the stirring speed increased and the lacquer is slowly added to the mixture. At this point nitrogen is continuously purged into the mixture to help drive off the organic solvent. The HE becomes suspended in the organic lacquer phase and the fluorocarbon is suspended in a separate phase. The stirring continues at high shear rates allowing the two phases to form an emulsion. The shearing/stirring is allowed to continue until most of the organic solvent has evaporated. This step is sometimes referred to as "polishing". Eventually the organic solvent evaporates or is "cold-trapped" and the HE particles are uniformly coated.

After the coating and polishing steps are complete the molding powder is filtered and harvested. The HE sample is then examined under a SEM to verify that a uniform coating quality has been applied to the sample surface.

In the process, the fluorinated oil is immiscible with the binder lacquer in forming the emulsion. Slowly evaporating off the solvent lacquer while maintaining the stirring and heating of these two phases provides an excellent polishing process for efficient and uniform coating to occur and eliminates the use of surfactants.

The inherent simplicity and efficiency of this coating method can provide high quality molding powders with minimum batch-to-batch variation. Additionally, good coating can ensure optimum safety properties (friction/impact stimuli and thermal cook-off behaviors) for the HE material.

This procedure can be developed into an ideal processing method for the safe, efficient, low-cost, non-polluting production of explosive molding powder. This technology can revolutionize the way pressible high explosives are produced.

EXAMPLE 1

1. Place Teflon bearing in bottom of molding powder mixer glassware. (Note: Teflon bearing keeps glass stirring paddle centered and prevents glass to glass contact during operation.) Place glass stirring paddle into molding powder mixer glassware. Do not proceed unless glass stirring paddle centering pin fits into Teflon bearing centering hole.

2. Attach molding powder mixer glassware to clamp on ringstand and attach glass stirring paddle to stir motor. Make sure Teflon bearing is all the way up over the centering pin on glass stirring paddle after attaching glass stirring paddle to stir motor.

3. Slowly turn rheostat on stir motor up to molding powder mixing speed (1200–1500 rpm) to check operation. Make sure there is very little vibration. Too much vibration means glass stirring paddle is not properly aligned with stir-motor and could cause damage to glassware and/or motor.

4. Place a glass beaker (1000–2000 ml) with a 1 inch stir-bar in bottom of beaker around molding powder mixer glassware. Glass beaker has an attached chain-clamp with handle to hold on to when beaker is hot. Slide stirrer/hot plate under glass beaker until beaker is centered on stirrer/hot plate.

5. Pour desired amount (about 150 ml) of fluorinated oil into molding powder mixer glassware.

6. The glass beaker that surrounds the molding powder glassware is filled with an inert oil that is compatible with high temperatures.

7. Turn stirrer/hot plate on to the desired stir speed. The speed of the stir-bar must not cause any splashing of the oil in glass beaker as to contaminate fluorinated oil in molding powder mixer glassware.

8. Turn heat on stirrer/hot plate. Monitor temperature in glass beaker with a thermometer with the temperature not to exceed about 60° C.

9. Dissolve polymeric binder in a small amount of organic solvent such as ethyl acetate, chloroform or methylene chloride to form the necessary lacquer.

10. Add the desired amount of HE (Cl-20, HMX, RDX, etc.) to the heated fluorinated oil liquid in the molding powder mixer while stirring at a low speed (about 400 rpm).

11. Slowly turn rheostat on stir motor up to molding powder mixing speed (about 1200–1500 rpm).

12. Slowly add the lacquer (normally, 5–10 ml/min.). The HE will be suspended in the organic lacquer phase and the non-polar fluorocarbon fluid will form the other phase. Upon stirring at high shear rates, these two phases will form a emulsion mixture allowing the suspended HE to come in contact with the binder lacquer. As the stirring and heating continues, a step referred to as "polishing", the organic solvent will gradually evaporate away or be "cold-trapped" for reuse and the HE particles will be uniformly coated with binder.

14. At the same time that the lacquer is being added to the HE mixture, the sample is purged with nitrogen to help accelerate the evaporation of the solvent.

13. After coating and polishing are complete, the molding powder is filtered for harvesting. The sample is vacuum dried for 16 hours @ 40° C. and examined under the SEM to determine coating quality.

14. Ideally, when examined under a SEM, the coating should appear as if all the edges of the molding powder have rounded edges. A crystal of molding powder which has not been properly coated will have sharp/jagged edges.

Since various changes and modifications can be made in the invention without departing from the spirit of the invention, the invention is not to be taken as limited except by the scope of the appended claims.

What is claimed is:

1. A process for making high explosive molding (HE) powder comprising the steps of:

adding an inert oil to a receptacle surrounding a vessel which will contain the molding powder;

heating said inert oil;

dissolving a polymeric binder in an organic solvent to form a lacquer;

adding a high explosive (HE) to said inert oil (hereinafter, mixture 1) with continuous mixing during the addition;

increasing mixing speed to the highest possible shear agitation rate without spilling sample;

adding said lacquer to said mixture 1 (hereinafter, mixture 2) with continuous mixing during the addition;

purging said mixture 2 with nitrogen and continually stirring and heating said mixture 2 during and after the addition to accelerate the evaporation of the solvent; and filtering and drying said mixture 2 to obtain HE molding powder.

2. A process, as in claim 1, wherein said inert oil is selected from the group consisting of perfluoroalkanes and perfluorotributylamines.

3. A process as in claim 1, wherein said inert oil is heated between 50° C.–70° C.

4. A process as in claim 1, wherein said polymeric binder is dissolved in an organic solvent at a ratio of 30–50:1 by volume, to form the lacquer.

5. A process as in claim 1, wherein said polymeric binder is selected from the group consisting of ethylene vinyl acetate (EVA), vinylidine fluoride and hexafluoropropylene copolymer (Viton A), glycidyl azide polymer (GAP), polyacrylic elastomer (Hytemp), polyethylene glycol (PEG), polycaprolactone and polyethylene glycol adipate.

6. A process as in claim 1, wherein said organic solvent is selected from the group consisting of ethyl acetate, octane, acetone, methylene chloride and chloroform.

7. A process as in claim 1, wherein said HE is selected from the group consisting of cyclotetramethylene tetranitramine (HMX), cyclotrimethylene trinitramine (RDX) and hexanitrohexaazaisowurtizane (CL-20).

8. A process as in claim 1, wherein said lacquer is added to said mixture 1 at a rate of 5–10 ml/min.

9. A process as in claim 1, wherein said purging with nitrogen and said stirring and heating of said mixture 2 takes place for about 40–90 minutes.

10. A process as in claim 1, wherein said molding powder is dried at about 40° C. for 16–24 hours.

* * * * *